US005109953A

United States Patent [19]

Mathis

[11] Patent Number: 5,109,953

[45] Date of Patent: May 5, 1992

[54] FORMWORK ARRANGEMENT FOR ERECTING A STRUCTURAL WALL

[75] Inventor: Hugo Mathis, Bregenz, Austria

[73] Assignee: Rund-Stahl-Bau Gesellschaft m.b.H., Fussbach, Austria

[21] Appl. No.: 698,132

[22] Filed: May 10, 1991

[30] Foreign Application Priority Data

May 17, 1990 [AT] Austria ..... 1103/90

[51] Int. Cl.[5] ..... E04B 1/16; E04G 11/28

[52] U.S. Cl. ..... 182/129; 182/142; 249/20

[58] Field of Search ..... 182/129, 142, 143, 145; 249/19, 20, 22, 33

[56] References Cited

U.S. PATENT DOCUMENTS

| | | | |
|---|---|---|---|
| 1,127,369 | 2/1915 | Nash | 182/129 |
| 3,192,594 | 7/1965 | Fougea | 249/33 |
| 4,016,228 | 4/1977 | Schmidt | 249/20 |
| 4,290,576 | 9/1981 | Schworer | 249/20 |
| 4,478,385 | 10/1984 | Maier | 249/20 |
| 4,562,989 | 1/1986 | Scheller | 249/19 |

*Primary Examiner*—Reinaldo P. Machado
*Attorney, Agent, or Firm*—Toren, McGeady & Associates

[57] ABSTRACT

A formwork arrangement for erecting a structural wall of castable material, for example, of concrete. The arrangement includes at least one work platform and formwork plates which have a large surface area. For erecting the structural wall, the formwork plates and the work platform are progressively vertically raised by the height of the formwork plates. A support frame which extends parallel to the platform is provided above the formwork plates of a formwork section. Horizontally extending rails which are horizontally spaced from each other are mounted on the support frame. The rails can be swiveled about a vertical axis. A carriage is slidably mounted on each of the rails. Each carriage has a suspended anchor member on a side facing the formwork plate. The anchor member can be connected to an upper edge of the formwork plates.

9 Claims, 2 Drawing Sheets

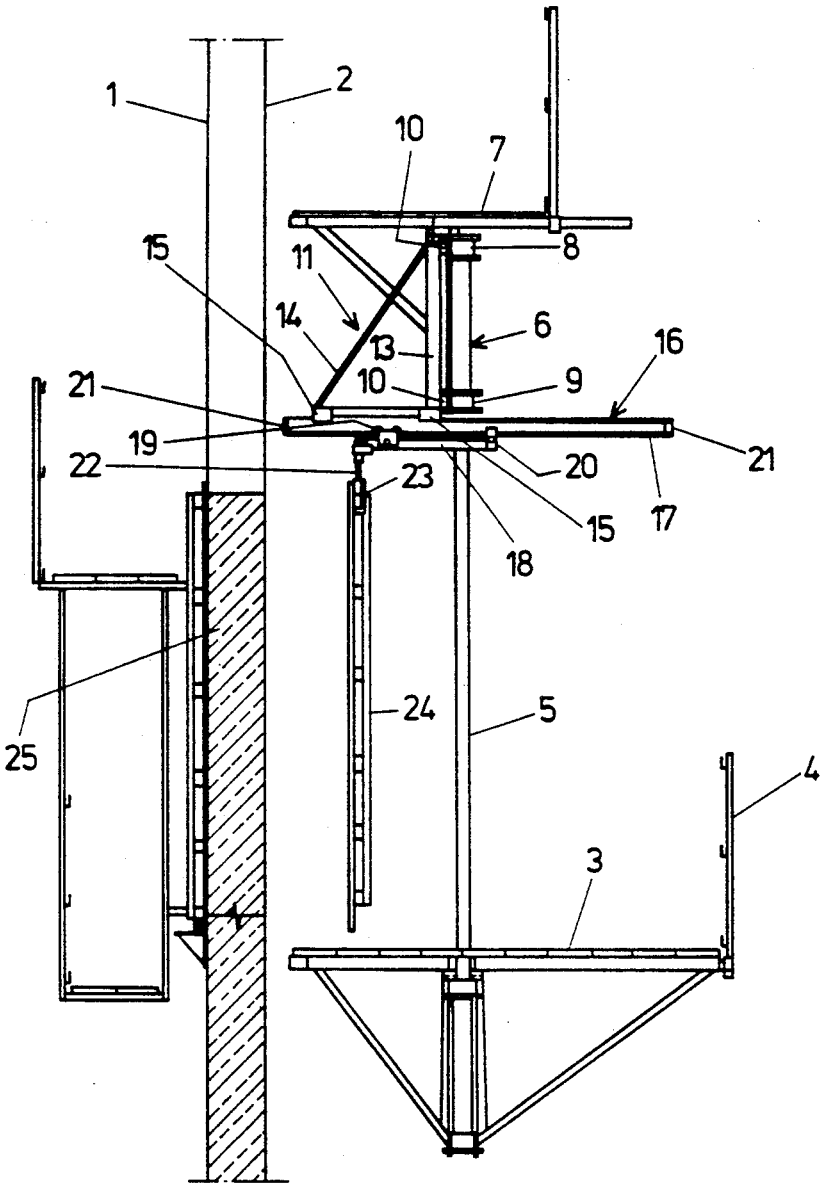
Fig. 2
Fig. 3
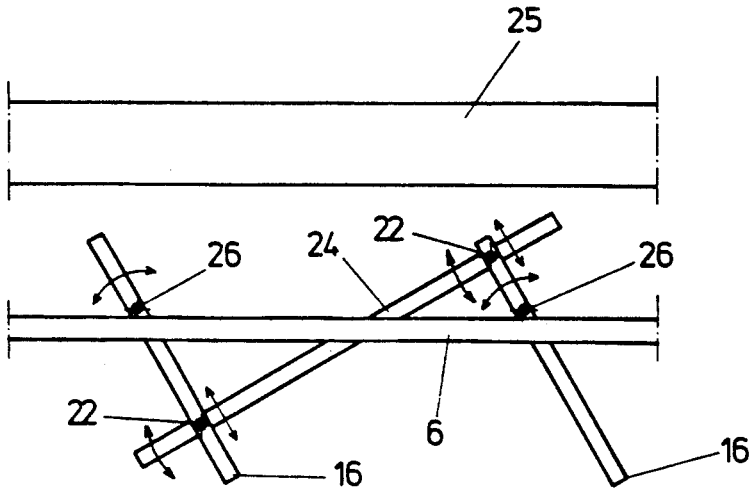

FORMWORK ARRANGEMENT FOR ERECTING A STRUCTURAL WALL

BACKGROUND OF THE INVENTION

1. Field of the Invention

The present invention relates to a formwork arrangement for erecting a structural wall of castable materials, for example, of concrete. The formwork arrangement includes at least one work platform and formwork plates which have a large surface area. The formwork plates preferably have the height of a story and/or are difficult to manipulate. For erecting the structural wall, the formwork plates and the work platform are progressively vertically raised by the height of the formwork plates.

2. Description of the Related Art

It is known in the art to use sliding formwork or climbing formwork for erecting structural walls of large-volume structures. The plates used in these formworks have the height of a story and the structural wall is progressively erected by vertically raising the formwork plates after the castable material has been cast behind the formwork plates and the material has set. A work platform is provided vertically on the level of the lower edge of the formwork plates. The formwork plates are manipulated from the work platform and the work platform is vertically raised together with the formwork plates as the construction of the wall progresses. When the formwork plates are removed after the castable material has set in order to raise the formwork plates, the plates must be cleaned at least on the side of the wall before they are again mounted for erecting the next wall section. However, cleaning of the formwork plates is extremely difficult because the work platform is frequently located at extreme heights and the work platform provides only very little room. In addition, the large-area formwork plates which are used in the formwork are extremely heavy and difficult to manipulate.

SUMMARY OF THE INVENTION

Therefore, it is the object of the present invention to provide an arrangement in formwork of the above-described type which makes easier the manipulations required for cleaning the formwork plates.

In accordance with the present invention, a support frame which extends parallel to the platform is provided above the formwork plates of a formwork section. Horizontally extending rails which are horizontally spaced from each other are mounted on the support frame. The rails can be swiveled about a vertical axis. A carriage is slidably mounted on each of the rails. The carriage has a suspended anchor member on the side facing the formwork plate. The anchor member can be connected to the upper edge of a formwork plate.

The various features of novelty which characterize the invention are pointed out with particularity in the claims annexed to and forming a part of this disclosure. For a better understanding of the invention, its operating advantages and specific objects attained by its use, reference should be had to the drawing and descriptive matter in which there is illustrated and described a preferred embodiment of the invention.

BRIEF DESCRIPTION OF THE DRAWING

In the drawing:

FIG. 2 is a vertical sectional view corresponding to FIG. 1, however, a formwork plate is raised from the set material for cleaning; and FIG. 3 is a schematic top view of the essential components of the arrangement according to the present invention.

DESCRIPTION OF THE PREFERRED EMBODIMENT

Figure 1:
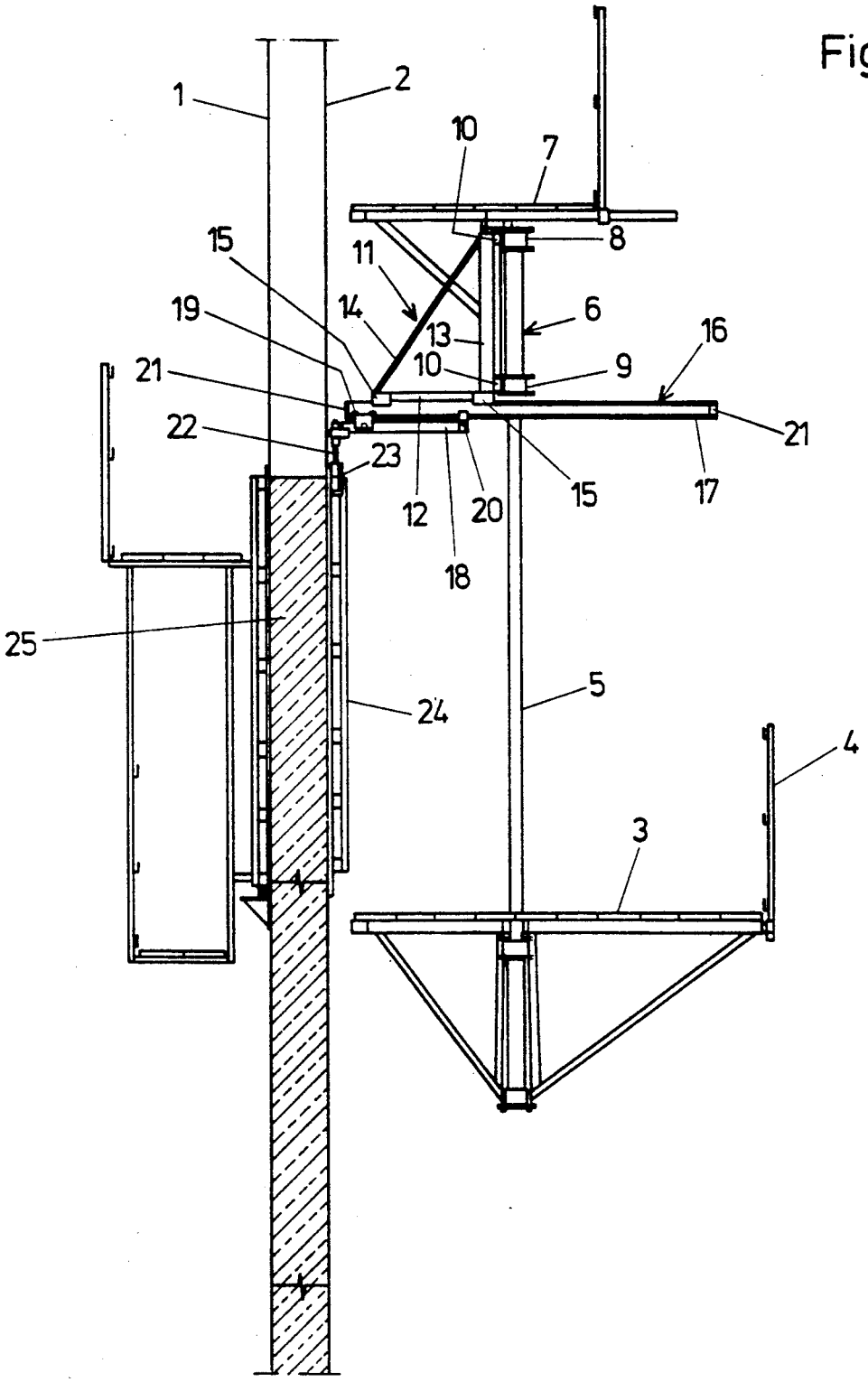
FIG. 1 is a schematic vertical sectional view of the formwork arrangement according to the present invention, with castable material being filled behind the formwork plates.

FIG. 1 of the drawing is a vertical sectional view and shows a wall to be erected and scaffolding used for erecting the wall. The wall to be erected and the thickness of the wall are indicated by two vertical lines 1 and 2. The shaded portion between the lines 1 and 2 represents an already finished wall 25. The wall may be plane over the length thereof or may be arched or curved. A work platform 3 with a safety railing 4 is mounted on vertically extending support members which are horizontally spaced apart from each other but are not illustrated for clarity's sake. The work platform 3 can be moved in vertical direction along the support members by means of lifting units which are also not illustrated, but are of a conventional type.

A support frame 6 is connected to the work platform 3 through vertical columns 5. The support frame 6 is of framework-type construction and extends corresponding or parallel to the work platform 3 and additionally supports another work platform 7 with a safety railing. A gallow-type cantilever 11 is hinged to the upper chord 8 and the lower chord 9 of the support frame 6 through hinges 10. The cantilever 11 has a lower leg 12, a vertical beam 13 and an inclined tension member 14, wherein these three structural components form a right triangle. The hinges 10 mentioned above are fastened in the upper and lower portions of the vertical beam 13.

A horizontally extending rail 16 is connected through connecting lugs 15 to the lower horizontal leg 12. The rail 16 preferably has an I-shaped cross-section. The connecting lugs 15 are advantageously constructed in such a way that the rail 16 can be displaced in its axial direction relative to the cantilever 11. A carriage 18 with bearing rollers 19 and support rollers 20 is supported on the lower flange 17 of the I-shaped rail 16. The carriage 18 can be moved along rail 16. The carriage 18 may be formed by a horizontal beam which may also be mounted displaceably relative to the fitting with the bearing rollers 19. The rail 16 has at least twice the length of the leg 12 of the gallow-type cantilever 11 which supports the rail 16.

The distance of displacement of the carriage 18 is limited by end stops 21 on the end faces of the rail 16. A vertical anchor member 22 is mounted so as to be rotatable about its vertical axis on that side of the carriage 18 which faces the formwork or the wall to be erected. In the position of operation illustrated in FIG. 1, the anchor member 22 is connected to the upper edge 23 of the formwork plate 24.

Two gallow-type cantilevers 11 are advantageously provided on the support frame 6 for each formwork plate 24, so that each formwork plate 24 is held at its upper edge by means of two anchor members 22.

As illustrated in FIG. 1, the castable material has been filled between the mounted formwork plates 24. As soon as the material has set, the formwork plate 24 hanging on a pair of anchor members 22 is separated from the formwork system and can be moved away from the wall while hanging on the anchor members 22, as illustrated in FIG. 2.

Since the gallow-type cantilever 11 is pivotable and since the anchor members 22 are rotatable, the formwork plate 24 can be pivoted about any chosen vertical axis, so that the formwork plate 24 can assume any angular position relative to the plane of the wall which makes the formwork plate easily accessible for cleaning.

The plan view of FIG. 3 shows in a simplified and schematic manner the inclined position of the formwork plate 24 which has been removed from the formwork system. In FIG. 3, only the essential components are shown and the points 26 represent the vertical pivot axes of the rails 16 formed by the hinges 10 of the gallow-type cantilever 11. The possible movements of the essential bearing points are represented by double arrows.

FIG. 3 of the drawing clearly shows that the formwork plate 24 can assume other angular positions relative to the wall 25. This is because the rails 16 together with the formwork plates 24 and the movably supported anchor members 22 form a type of parallelogram transmission system which can be adjusted in a selected manner.

The invention has been explained above with the aid of the drawing in connection with an outer formwork. However, the arrangement according to the present invention can also be used on an inner formwork. Also, while the invention has been explained above with plane formwork plates for erecting a plane wall, the formwork plates can also be arched if the wall to be erected is ring-shaped or circular in cross-section, for example, a tower. In this case, the work platform 3 and the support frame 6 are also ring-shaped or circular.

The arrangement according to the present invention makes it possible to manipulate heavy formwork plates which have a large surface area and have the height of a story without difficulties for cleaning purposes within a narrow space of a work platform. The arrangement of the invention can also be used successfully in situations where the formwork plates are relatively small but have a great weight and/or are difficult to manipulate.

While a specific embodiment of the invention has been shown and described in detail to illustrate the application of the inventive principle, it will be understood that the invention may be embodied otherwise without departing from such principles.

I claim:

1. In a formwork arrangement for erecting a structural wall of castable materials, the formwork arrangement including at least one work platform and formwork plates which have a large surface area, each formwork plate having a height, and means for progressively vertically raising the formwork plates and the work platform by the height of the formwork plates, the improvement comprising a support frame mounted above the formwork plates of a formwork section, the support frame extending parallel to the platform, horizontally extending rails which are horizontally spaced from each other being mounted on the support frame, the rails being swivelable about a vertical axis, a carriage being slidably mounted on each of the rails, each carriage having a suspended anchor member on a side facing the formwork plate, and means for connecting the anchor member to an upper edge of a formwork plate.

2. The arrangement according to claim 1, wherein each rail is mounted on a gallow-type cantilever, the cantilever being swivelable about a vertical axis.

3. The arrangement according to claim 1, wherein two rails arranged successively along the formwork have a spacing from each other in horizontal direction which is equal to or smaller than the length of a formwork plate.

4. The arrangement according to claim 2, wherein the gallow-type cantilever is hinged to the support frame mounted above the formwork plates.

5. The arrangement according to claim 2, wherein the gallow-type cantilever has a horizontally extending leg connected to the rail, a vertically extending beam which is directed upwardly and arranged on an end of the leg, wherein the leg and the beam each have a free end, the cantilever further including a tension member which connects the free ends of the leg and of the beam.

6. The arrangement according to claim 1, wherein the rails have an I-shaped cross-section.

7. The arrangement according to claim 1, wherein the carriage slidable on the rail comprises bearing rollers and support rollers.

8. The arrangement according to claim 1, wherein the suspended anchor member is received by the carriage so as to be rotatable about its vertical axis.

9. The arrangement according to claim 2, wherein the rail is mounted on the cantilever so as to be displaceable in axial direction.

* * * * *